United States Patent [19]

Schneiter

[11] 4,004,411

[45] Jan. 25, 1977

[54] COUNTING MECHANISM FOR TIMEPIECE

[75] Inventor: Ali Schneiter, Neuchatel, Switzerland

[73] Assignee: Ebauches S.A., Neuchatel, Switzerland

[22] Filed: Mar. 25, 1976

[21] Appl. No.: 670,630

[30] Foreign Application Priority Data

Apr. 1, 1975 Switzerland ..... 4069/75

[52] U.S. Cl. ..... 58/116 M; 58/116 R; 58/59; 58/28 R; 74/1.5; 58/107

[51] Int. Cl.[2] ..... G04B 15/00

[58] Field of Search ..... 58/107, 108, 109, 110, 58/112, 116 R, 116 M, 59, 28 R, 28 A–28 D; 74/1.5; 310/49 R

[56] References Cited

UNITED STATES PATENTS

| | | | |
|---|---|---|---|
| 3,158,988 | 12/1964 | Walmer | 58/23 D |
| 3,704,582 | 12/1972 | Wuthrich | 58/116 R |
| 3,719,839 | 3/1973 | Endo | 74/1.5 X |

*Primary Examiner*—Ulysses Weldon

*Attorney, Agent, or Firm*—St. Onge Mayers Steward & Reens

[57] ABSTRACT

A counting mechanism for timepiece having a bidirectional step by step motor, in which the rotor of the said motor cooperates directly with a counting wheel in such a way as to drive it only in one direction, this counting wheel being submitted to the action of a magnet which determines, at each step, its position while cooperating successively with each tooth of its toothing.

1 Claim, 2 Drawing Figures

COUNTING MECHANISM FOR TIMEPIECE

BACKGROUND OF THE INVENTION

It is necessary, in counting mechanisms, to maintain the positioning torque which acts on the counting wheel at a certain value underneath which one cannot go, otherwise the viability of the operation of the mechanism will not be ensured, the counting wheel having the risk of no more advancing but of oscillating on itself, in a go and back movement.

The counting mechanisms of the above mentioned type, in which the positioning torque is obtained by a magnet, do not show adjusting means of the force exerted on the counting wheel by this magnet so that it is not possible to adjust this force to a value just higher than the minimum value ensuring a good operation, so that it is necessary to maintain a margin of security which has for effect a less of energy. As a matter of fact, at each pulse, the motor, most generally a balance wheel, is obliged to furnish a torque higher than the mere antagonist torque due to the resistance to the rotation of the time indicators.

The object of the present invention is to furnish an adjusting means of the positioning force exerted on the counting wheel by the positioning magnet, thus permitting to maintain this force at a minimum and, consequently, also to reduce to a minimum the supplement of energy which has to be furnished by the motor for overcoming this force.

To this effect, the counting mechanism according to the invention is characterized by the fact that the positioning magnet acting on the counting wheel is carried by a resilient blade submitted to the action of an adjusting screw against which it is elastically bearing. Rotation of this screw, in one direction or in the other, permits the magnet to move in one direction or in the other one and brings it closer to, or farther from, the plane of the counting wheel with which it cooperates, so as to permit the force it exerts on the said wheel to vary.

The drawing shows, by way of example, one embodiment of the object of the invention.

Figure 1:
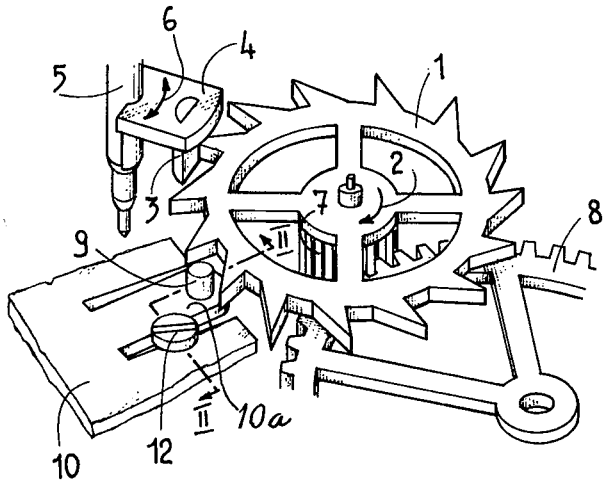
FIG. 1 is a perspective view of a counting mechanism for a timepiece.
Figure 2:
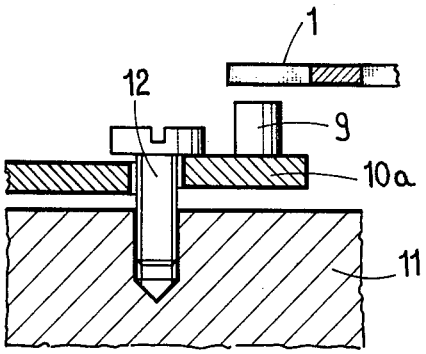
FIG. 2 is a sectional view of a detail, at a larger scale, along line II—II of FIG. 1.

The counting mechanism represented comprises a counting wheel 1 driven step by step, in the direction of the arrow 2, by a pin 3 carried by a plate 4 rigid with the shaft 5 of a driving balance wheel which oscillates along the direction of the arrow 6, and which has not been represented. This wheel 1 is rigid with a pinion 7 driving the time-indicator gearing of the movement, only one wheel 8 of which has been represented.

The stability of the several positions of the wheel 1 is ensured by a permanent magnet 9 opposite which the several teeth of the wheel 1 are successively located, when this wheel is stationary. The magnet 9 is carried by a resilient blade 10*a* cut in a sheet 10 secured to the frame 11 of the movement. This resilient blade 10*a* is slightly bent out of the plane of the sheet 10, towards the wheel 1, and is submitted to the action of an adjusting screw 12 against the head of which this blade is bearing by its own elasticity.

Hence, while screwing unscrewing the screw 12, magnet 9 is displaced, in one direction or in the other, bringing it closer to, or farther from, the plane of the wheel 1, thereby modifying the force it exerts on the wheel and, consequently, the value of the positioning torque.

What I claim is:

1. Counting mechanism for timepiece having a bidirectional step by step motor, in which the rotor of the said motor cooperates directly with a counting wheel in such a way as to drive it only in one direction, this counting wheel being submitted to the action of a magnet which determines, at each step, its position while cooperating successively with each tooth of its toothing, characterized by the fact that the said magnet is carried by a resilient blade submitted to the action of an adjusting screw against which it is elastically bearing, the rotation of this screw, in one direction or in the other, permitting to move the said magnet in one direction or in the other one and to bring it closer to or farther from the plane of the counting wheel with which it cooperates, so as to permit to vary the force it exerts on the said wheel.

* * * * *